United States Patent [19]

Gavignet

[11] Patent Number: 5,070,949

[45] Date of Patent: Dec. 10, 1991

[54] METHOD OF ANALYZING FLUID INFLUXES IN HYDROCARBON WELLS

[75] Inventor: Alain Gavignet, Sevres, France

[73] Assignee: Schlumberger Technology Corporation, Houston, Tex.

[21] Appl. No.: 701,352

[22] Filed: May 10, 1991

Related U.S. Application Data

[63] Continuation of Ser. No. 539,282, Jun. 18, 1990, abandoned, which is a continuation of Ser. No. 227,406, Aug. 2, 1988, abandoned.

[30] Foreign Application Priority Data

Aug. 7, 1987 [FR] France ..... 87 11258

[51] Int. Cl.[5] ..... E21B 47/10; E21B 21/08

[52] U.S. Cl. ..... 175/48; 73/155; 175/50

[58] Field of Search ..... 175/48, 50, 25; 73/155

[56] References Cited

U.S. PATENT DOCUMENTS

| | | | |
|---|---|---|---|
| 3,760,891 | 9/1973 | Gadbois | 175/48 |
| 3,968,844 | 7/1976 | Walter, Jr. et al. | 175/48 |
| 4,253,530 | 3/1981 | Sharki et al. | 175/25 |
| 4,553,429 | 11/1985 | Evans et al. | 73/155 |
| 4,606,415 | 8/1986 | Gray, Jr. et al. | 175/48 X |
| 4,635,735 | 1/1987 | Crownover | 175/48 |
| 4,733,233 | 3/1988 | Grosso et al. | 175/48 X |
| 4,867,254 | 9/1989 | Gavignet | 175/48 |
| 5,006,845 | 4/1991 | Calcar et al. | 175/48 X |

FOREIGN PATENT DOCUMENTS

| | | |
|---|---|---|
| 292328 | 8/1971 | Austria . |
| 1815725 | 7/1969 | Fed. Rep. of Germany . |

OTHER PUBLICATIONS

World Oil, vol. 199, No. 7, Dec., 1984, pp. 75, 76, 78, 80, 82, Gulf Publ. Co., Houston, TX, U.S.A.; A. T. Bourgoyne, Jr., "Bubble chopping: a new way to control large, deep gas kicks", p. 75, colonne de droite–p. 76, colonne intermediaire.

*Primary Examiner*—Hoang C. Dang

*Attorney, Agent, or Firm*—John J. Ryberg; Henri Dupont; Martin Hyden

[57] ABSTRACT

The invention relates to a method of analysing fluid influxes into an oil well from an underground formation. During a drilling mud transient flow state, the successive values of the rate $Q_i$ or pressure $p_r$ of injection of the drilling mud into the well and the successive values of the rate $Q_r$ or pressure $p_r$ of return of the drilling mud to the surface are measured. The changing values of the rate or pressure of injection are compared with the changing values of the return rate or pressure. From this comparison the nature and volume of the fluids that have penetrated into the well are determined.

12 Claims, 3 Drawing Sheets

9
17
8
16
21
18
3
24
22
4
7
6
19
12
20
13
5
14
15
10
4
1
2

METHOD OF ANALYZING FLUID INFLUXES IN HYDROCARBON WELLS

This is a continuation of application Ser. No. 07/539,282 filed June 18, 1990, which was a continuation of application Ser. No. 07/227,406 filed Aug. 2, 1988, both now abandoned.

The invention relates to a method of dynamically analysing fluid influxes into a hydrocarbon well during drilling. When during the drilling of a well, after passing through an impermeable layer, a permeable formation is reached containing a liquid or gaseous fluid under pressure, this fluid tends to flow into the well if the column of drilling fluid, known as drilling mud, contained in the well is not able to balance the pressure of the fluid in the aforementioned formation. The fluid then pushes the mud upwards. There is said to be a fluid influx or "kick". Such a phenomenon is unstable: as the fluid from the formation replaces the mud in the well, the mean density of the counter-pressure column inside the well decreases and the unbalance becomes greater. If no steps are taken, the phenomenon runs away, leading to a blow-out.

This influx of fluid is in most cases detected early enough to prevent the blow-out occurring, and the first emergency step taken is to close the well at the surface by means of a blow-out preventer.

Once this valve is closed, the well is under control. The well then must be cleared of formation fluid, and the mud then weighted to enable drilling to continue without danger. If the formation fluid that has entered the well is a liquid (brine or hydrocarbons, for example), the circulation of this fluid does not present any specific problems, since this fluid scarcely increases in volume during its rise to the surface and, therefore, the hydrostatic pressure exercised by the drilling mud at the bottom of the well remains more or less constant. If on the other hand the formation fluid is gaseous, it expands on rising and this creates a problem in that the hydrostatic pressure gradually decreases. To avoid fresh influxes of formation fluid being induced during "circulation" of the influx, in other words while the gas is rising to the surface, a pressure greater than the pressure of the formation has to be maintained at the bottom of the well. To do this, the annulus of the well, this being the space between the drill string and the well wall, must be kept at a pressure such that the bottom pressure is at the desired value. It is therefore very important for the driller to know as early as possible, during circulation of the influx, if a dangerous incident is on the point of occurring, such as a fresh influx of fluid or the commencement of mud loss due to the fracture of the formation.

The means of analysis and control available to the driller comprise the mud level in the mud tank, the mud injection pressure into the drill pipes, and the well annulus surface pressure.

These three data allow the driller to calculate the volume and nature of the influx, and also the formation pressure. It is on this information that he bases his influx circulation program.

Interpreting the data nevertheless poses some problems. Firstly, the assessment of the volume of the influx, which is important in order to determine the nature of that influx, is inaccurate. It is in fact made by comparing the mud level in the tank with a "normal" level, i.e. the level that would occur in the absence of the influx But this reference is difficult to determine: on one hand the mud level changes constantly during drilling, because part of the mud is ejected with the well cuttings; on the other, the mud level in the pits rises when the well is closed, because the mud return lines empty. The estimate of the influx volume is therefore approximate. As a result, determining the nature of the influx is also uncertain. The influx density calculations thus often lead to the conclusion that the influx is a mixture of gas and liquid (oil or water) whereas it may in fact be a gas or a liquid only. It should also be noted that this calculation can not be made when the influx is in a horizontal part of the well.

For all these reasons, influx analysis is not regarded as a reliable technique today.

The present invention offers a method of analysing influxes into an oil well that is free from the above drawbacks According to this method a system, preferably automatic, of acquisition and processing of data supplied by sensors on a drilling rig is used to improve influx analysis. Generally the proposal is to use the data supplied by the drill mud transient flow states in order to estimate the nature of the fluids in the well annulus. The proposed method may be applied whatever the deviation from the vertical of the well in question.

More precisely, the present invention relates to a method of analysing a fluid influx or influxes into a well from an underground formation, according to which measurements are made of the successive values of at least one first parameter relating to the flow rate $Q_i$ or pressure $p_i$ of injection of the drilling mud into the well and the successive values of at least one second parameter relating to the flow rate $Q_r$ or pressure $p_r$ of return of the drilling mud to the surface. The changing values of the first parameter are compared to the changing values of the second parameter and from this comparison a value is determined which is a function of the compressibility X of the fluids in the well.

The characteristics and advantages of the invention will be seen more clearly from the description that follows, with reference to the attached drawings, of a non-limitative example of the method mentioned above.

Figure 1:
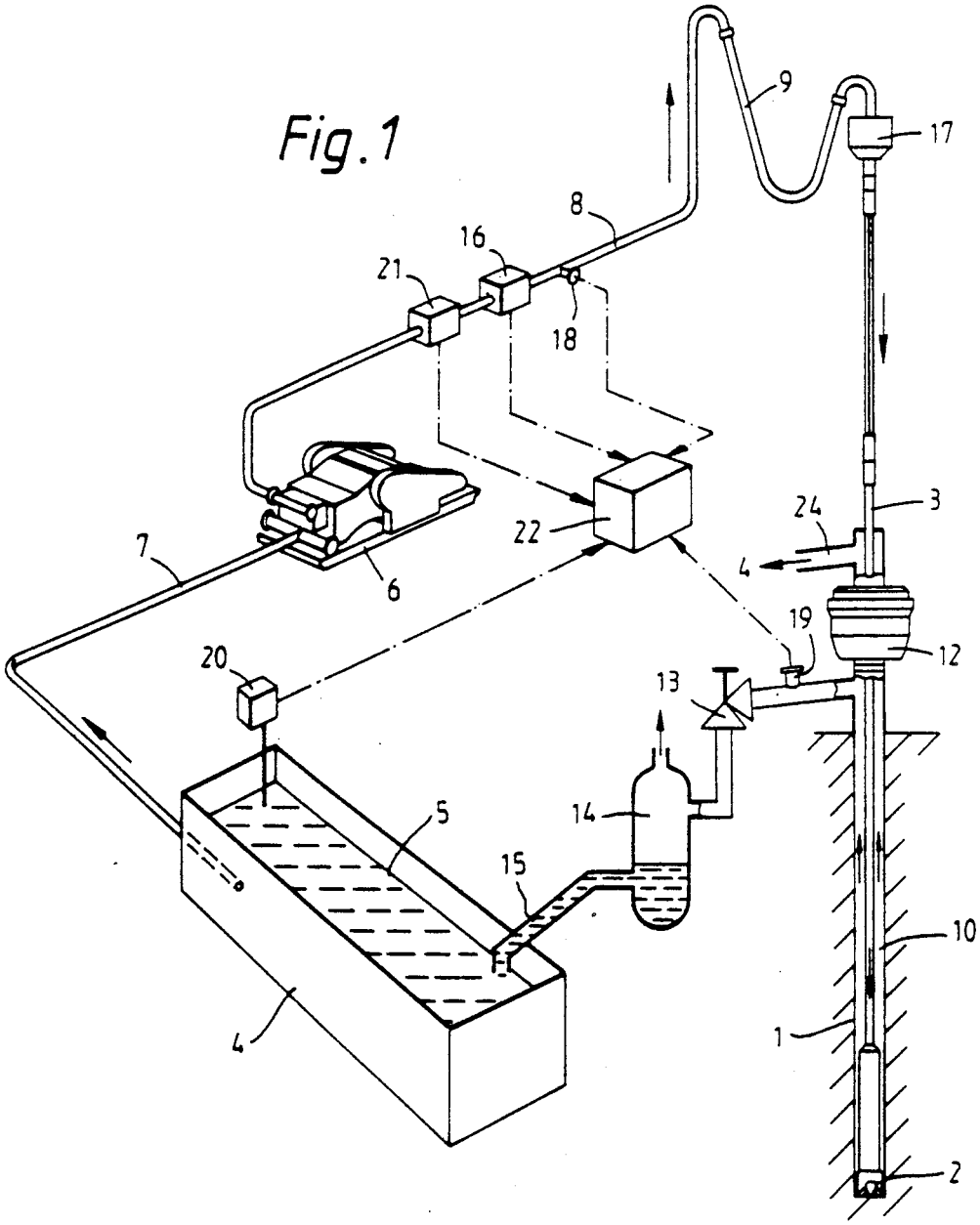
FIG. 1 shows in diagram form the drilling mud circuit of a well during control of an influx.

FIG. 1 shows the mud circuit of a well 1 during a formation fluid influx control operation. The bit 2 is attached to the end of a drill string 3. The mud circuit comprises a tank 4 containing drilling mud 5, a pump 6 sucking mud from the tank 4 through a pipe 7 and discharging it into the well 1, through a rigid pipe 8 and flexible hose 9 connected to the tubular drill string 3 via a swivel 17. The mud escapes from the drill string when it reaches the bit 2 and returns up the well through the annulus 10 between the drill string and the well wall. In normal operation the drilling mud flows through a blow-out preventer 12 which is open. The mud flows into the mud tank 4 through a line 24 and through a vibratory screen not shown in the diagram to separate the cuttings from the mud. When a fluid influx is detected, the valve 12 is closed. Having returned to the surface, the mud flows through a choke 13 and a degasser 14 which separates the gas from the liquid. The drilling mud then returns to the tank 4 through line 15.

The mud inflow rate $Q_i$ is measured by means of a flow meter 16 and the mud density $d_m$ is measured by means of a sensor 21, both of these fitted in line 8. The injection pressure $p_i$ is measured by means of a sensor 18 on rigid line 8. The return pressure $p_r$ is measured by means of a sensor 19 fitted between the blow-out preventer 12 and the choke 13. The mud level n in the tank 4 is measured by means of a level sensor 20 fitted in the tank 4.

The signals $Q_i$, $d_m$, $p_i$, $p_r$ and n thus generated are applied to a processing device 22, where they are processed during the dynamic analysis cf an influx as suggested within the scope of the present invention. It may, however, be noted that in order to exploit the present invention it is sufficient to measure $p_r$ or $Q_r$ on one hand and $Q_i$ or $p_i$ on the other.

Figure 2:
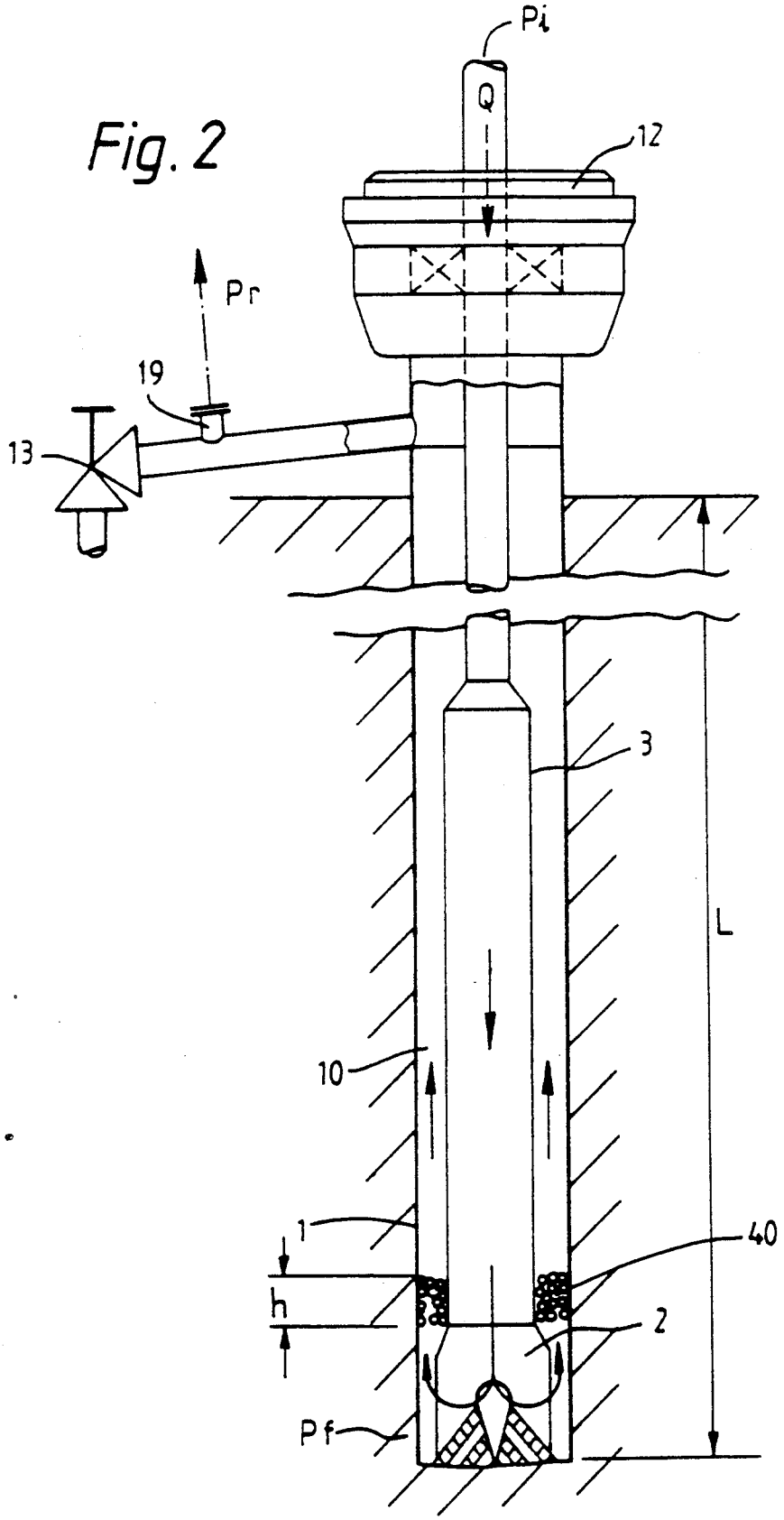
FIG. 2 shows in diagram form the hydraulic circuit of a well during control of a gas influx.

FIG. 2 represents in simplified form the hydraulic circuit of a well when the operator is preparing to circulate the formation fluids that have entered the well. Immediately after detecting an influx, the pumps are shut down and the blow-out preventer 12 and choke 13 are closed. The well is thus isolated. The driller then measures the pressure $p_i$ in the pipes by means of the sensor 18 and the pressure $p_r$ in the annulus by means of sensor 19 between the wellhead and the control choke 13.

For the sake of clarity in explaining the method it will be assumed here that the section of the annulus has a constant area A from the bottom to the top of the well. But the method may be used even if this section is not of constant area.

In a first approximation it may be assumed that the influx is a single-phase plug 40 of density $d_i$ and height h encountered at the bottom of the well at depth L. The volume $V_i$ of this influx may be estimated by the increase in the level n of mud in the tank 4 associated with the entry of the formation fluid into the well. Let L be the total depth of the well, in other words the difference in elevation between the sensor 19 and the bit 2. Let us assume the influx is distributed through the mud over a distance h, as is shown in FIG. 2. The value of h is calculated as follows:

$$h = \frac{V_i}{A}$$

The density $d_i$ of the influx is then calculated by the following formula:

$$d_i = d_m - \frac{p_r - p_i}{g\,h\cos(f)}$$

where $d_m$ is the density of the mud at the moment of detecting the influx, and f is the angle of deviation of the well from the vertical at the depth at which the influx is encountered. This calculation makes it possible to identify the type of fluid that has entered the well. However, as the estimate of $V_i$ obtained by observing the mud level in the tank 4 is marred by errors, it is difficult in practice to use this method to determine the nature of the influx.

It is therefore advantageous to obtain more information on the situation of the annulus. In the present invention it is proposed to use a dynamic method, in contrast to the method described above which may be described as static, in that it is based on data that are stable over time.

If the pump 6 is started up to circulate the influx, the annular surface pressure rises, because overpressure is generally applied at the bottom of the well to prevent any fresh influxes. Due to the compressibility of the fluids contained in the drill pipes and in the annulus, there is a delay between the increase of the flow rate at the pumps and the increase of the pressure in the system. Part of the mud injected in fact compresses the well fluids during the transient stage of pump start-up. During this period a transient state exists The injection rate $Q_i$ and the return rate $Q_r$ are different, $Q_r$ increasing or decreasing more slowly, with some delay in relation to any variation in $Q_i$. The same is true of variations in the return pressure $p_r$ in relation to variations in the injection pressure $p_i$. On FIG. 2, $Q_i$ is the drilling mud rate measured by sensor 16 fitted on line 8 and $Q_r$ is the mud flow rate through choke 13.

In a steady state, the following obtains:

$$Q_i = Q_r \tag{1}$$

Due to the fact that the volume of mud contained in the annulus is considerably greater than that contained in the drill pipes, the annular pressure delay effect may be regarded as being largely due to the volume of mud in the annulus, and the pipe volume may be disregarded. The transients may then be described by the following equation:

$$\frac{(Q_i - Q_r)}{V_a}\,dt = X_a dp_r \tag{2}$$

where $V_a$ is the total volume of the annulus, $X_a$ is the compressibility of the annulus and $dp_r$ is the variation in the return pressure $p_r$ occurring during time period dt.

$Q_r$ is generally not measured directly in the system as described in FIG. 1, but the method described here could be applied all the more easily if such a measurement were made. Between $Q_r$ and pressure $p_r$ measured by sensor 19 there is a relationship of the type:

$$p_r = k_d Q_r^2 \tag{3}$$

kd being a coefficient characterizing the choke when it has a given opening. If therefore the values of $Q_i$ and $p_r$ are recorded by the processing system 22 during a change of rate, it is possible to determine the values of the product of $X_a V_a$ and the choke constant $k_d$ by means of the following differential equation obtained by combining equations (2) and (3):

$$\frac{dt}{X_a V_a} = \frac{dp_r}{Q_i - \sqrt{\frac{p_r}{k_d}}} \tag{4}$$

The two unknowns $X_a V_a$ and $k_d$ may be determined for example by applying the least error squares method or any other known smoothing method. One example of application is described below with reference to FIG. 3 and data table I. It will be noted that equation (4) now contains only one unknown, $X_a V_a$, if the output rate $Q_r$ is measured. By way of example, equation (4) may be written as follows:

$$Q_i - \frac{\sqrt{p_r}}{\sqrt{k_d}} = X_a V_a \frac{dp_r}{d_t} \tag{5}$$

or again $$\frac{Q_i}{\sqrt{p_r}} = \frac{1}{\sqrt{k_d}} + X_a V_a \frac{1}{\sqrt{p_r}} \cdot \frac{dp_r}{d_t} \quad (6)$$

where the values of $Q_i$ and $p_r$ are measured as a function of time t. It will be noted that equation (6) is of the form $y=ax+b$, which is the equation of a straight line. The successive values of y and x are calculated from the measured values of $Q_i$ and $p_r$, and the slope $a=X_aV_a$ of the straight line and its intercept time $b=1/\sqrt{k_d}$ are determined. This gives the values of $X_aV_a$ and $k_d$.

If the annulus is partly filled by a volume $V_g$ of gas the compressibility of which is $X_g$, and if the compressibility of the drilling mud is $X_b$, the following equation obtains:

$$X_aV_a = X_b(V_a - V_g) + X_gV_g \quad (7)$$

In normal drilling conditions, the compressibility of gas is very high compared to that of mud. Consequently, if a fraction of the annulus is filled with gas, $$X_aV_a \approx X_gV_g \quad (8)$$

The delay in changes of pressure $p_r$ observed at the choke in relation to the variations in the pump rate is highly sensitive to the presence of gas in the annulus. The compressibility of a gas is in a first approximation the inverse of the pressure of that gas:

$$X_g \approx \frac{1}{p_g} \quad (9)$$

where $p_g$ is the mean pressure of the gas in the annulus. If the gas has penetrated into the annulus during an influx, the greater part of the gas is at the bottom pressure, which may be estimated in the classic way by measuring the surface pressure in the pipes after closing the blow-out preventer. If therefore $X_aV_a = X_gV_g$, the volume of gas $V_g$ may then be estimated, since the value of $X_aV_a$ is known from equation (4) and the value of $X_g$ from equation (9). This is useful on one hand to confirm (or invalidate) the estimate of the gas influx volume made from the rise in the mud level in tank 4. It may even prove indispensible if the well is horizontal, since it is then impossible to use differences in hydrostatic pressure to estimate the nature of the influx.

According to one embodiment, the method therefore consists in circulating the mud slowly through choke 13, and simultaneously recording the pressure $p_r$ read by sensor 19 and the rate $Q_i$ read by sensor 16 during the transient period. These data are then interpreted and the values of $X_aV_a$ and $k_d$ calculated. Since the volume $V_a$ of the annulus is known, it is possible to estimate a mean compressibility $X_a$ of the fluids contained in the annulus. If the value obtained is high compared to a predetermined value, which may be the compressibility $X_m$ of the mud, if this value is known, or alternatively the value of $X_a$ previously determined by the same method but in the absence of gas (during a calibration operation, for instance), it may be concluded that the fluid arriving from the formation is a gas. Once the presence of gas has been confirmed, its volume may be estimated.

It should be noted that if it is difficult for operational reasons to circulate the mud through the choke 13 in order to study the pressure transients at that choke, it is also possible, according to an alternative embodiment of the invention, to measure the pressure increase at the choke 13 by means of sensor 19 when a known volume is injected into the annulus, in other words when the well is pressurized by a few strokes of the pump 6. This increase in the volume of mud dV also allows $X_aV_a$ to be calculated from the equation $dV = X_aV_a\, dp_r$, where $dp_r$ is the pressure variation at the choke 13.

Figure 3:
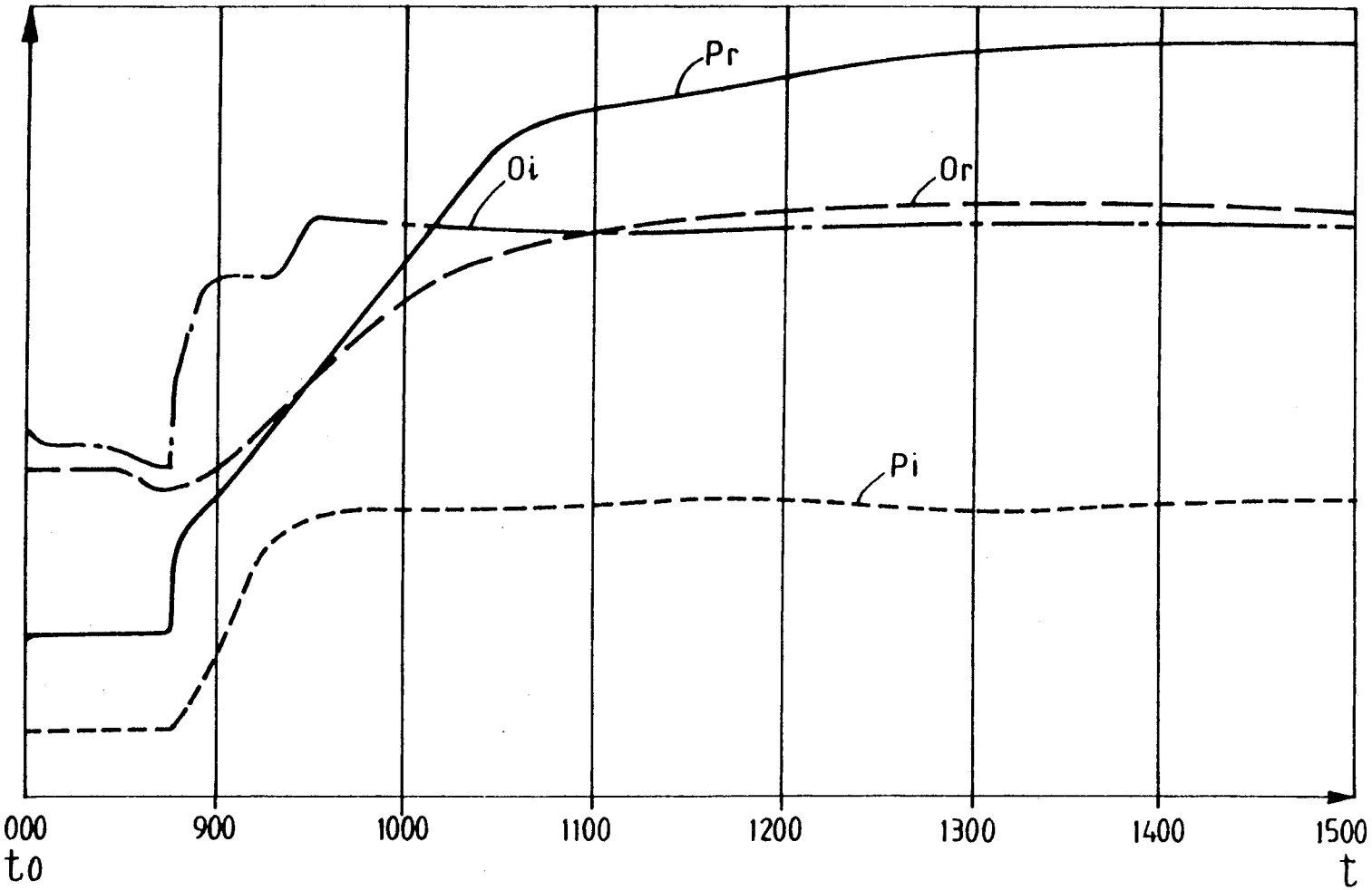
FIG. 3 shows an example of pressure and flow rate curves as a function of time, as observed during tests in an experimental well.

FIG. 3 illustrates the proposed method within the scope of the present invention Data plotted in FIG. 3 were obtained from tests carried out under controlled conditions where a known quantity of gas was injected at the bottom of an experimental well. The pressure delay $p_r$ with a change of rate $Q_i$ may be noted on the recording in FIG. 3 made as a function of time t. This figure also shows variations in the output rate $Q_r$ and injection pressure $p_i$. It will be noted that the values of $Q_r$ also change with some delay compared to the values of $Q_i$ or $p_i$. Table I gives the values of $Q_i$ (in $cm^3/s$) and $p_r$ (in bar) measured and represented on FIG. 3 as a function of time t and the corresponding calculated values y and x of equation (6) with:

$$y = \frac{Q_i}{\sqrt{p_r}},\ x = \frac{1}{\sqrt{p_r}} \cdot \frac{dp_r}{dt}$$

By means of these values the following values have been determined: $k_d = 0.512\ g/cm^7$, $X_aV_a = 0.00294\ cm^4\ s^2/g$ and $V_g = 859$ litres at gas pressure $p_g = 283$ bar.

TABLE I

| t | $Q_i$ | $p_r$ | x | y |
|---|---|---|---|---|
| 904. | 8263.9 | 27.33 | 0 | 1.581 |
| 906. | 8263.9 | 27.33 | 31.88 | 1.581 |
| 908. | 8263.9 | 27.67 | 31.69 | 1.571 |
| 910. | 8327.0 | 28.00 | 15.75 | 1.574 |
| 914. | 8327.0 | 28.33 | 31.31 | 1.564 |
| 916. | 8327.0 | 28.67 | 15.56 | 1.555 |
| 920. | 8327.0 | 29.00 | 30.95 | 1.546 |
| 922. | 8263.9 | 29.33 | 30.77 | 1.526 |
| 926. | 8263.9 | 30.00 | 15.21 | 1.509 |
| 930. | 8263.9 | 30.33 | 30.26 | 1.500 |
| 932. | 8263.9 | 30.67 | 15.05 | 1.492 |
| 936. | 8327.0 | 31.00 | 29.93 | 1.496 |
| 938. | 8768.6 | 31.33 | 59.55 | 1.566 |
| 940. | 8579.3 | 32.00 | 0 | 1.517 |
| 942. | 8705.5 | 32.00 | 0 | 1.539 |
| 944. | 8705.5 | 32.00 | 44.19 | 1.539 |
| 948. | 9020.9 | 33.00 | 43.52 | 1.570 |
| 952. | 9084.0 | 34.00 | 28.58 | 1.558 |
| 954. | 9084.0 | 34.33 | 28.44 | 1.550 |
| 958. | 9020.9 | 35.00 | 0 | 1.525 |
| 960. | 9020.9 | 35.00 | 56.34 | 1.525 |
| 962. | 8957.8 | 35.67 | 0 | 1.500 |
| 964. | 8957.8 | 35.67 | 27.91 | 1.500 |
| 968. | 9020.9 | 36.33 | 0 | 1.497 |
| 970. | 9020.9 | 36.33 | 27.65 | 1.497 |
| 974. | 9020.9 | 37.00 | 13.70 | 1.483 |
| 978. | 9020.9 | 37.33 | 0 | 1.476 |
| 980. | 9020.9 | 37.33 | 13.64 | 1.476 |
| 984. | 8957.8 | 37.67 | 27.16 | 1.460 |
| 988. | 9020.9 | 38.33 | 0 | 1.457 |
| 990. | 9020.9 | 38.33 | 13.46 | 1.457 |
| 994. | 9020.9 | 38.67 | 0 | 1.451 |
| 996. | 9020.9 | 38.67 | 0 | 1.451 |
| 998. | 9020.9 | 38.67 | 26.80 | 1.451 |
| 1000. | 9020.9 | 39.00 | 8.896 | 1.445 |
| 1006. | 9020.9 | 39.33 | 0 | 1.438 |
| 1010. | 9020.9 | 39.33 | 26.57 | 1.438 |
| 1012. | 9020.9 | 39.67 | 0 | 1.432 |
| 1016. | 8957.8 | 39.67 | 26.46 | 1.422 |
| 1018. | 8957.8 | 40.00 | 0 | 1.416 |
| 1022. | 9020.9 | 40.00 | 13.18 | 1.426 |
| 1052. | 8957.8 | 41.33 | 0 | 1.393 |
| 1072. | 8957.8 | 41.67 | 0 | 1.388 |
| 1102. | 8957.8 | 42.33 | 0 | 1.377 |
| 1122. | 9084.0 | 42.67 | 0 | 1.391 |

TABLE I-continued

| t | $Q_i$ | $p_r$ | x | y |
|---|---|---|---|---|
| 1150. | 9147.1 | 43.33 | 0 | 1.390 |

I claim:

1. A method of controlling a well drilling operation, said method comprising the steps of:

monitoring drilling parameters to detect a fluid influx;

isolating the well on detection of the fluid influx;

creating a transient fluid dynamic state of drilling mud in the well;

measuring at least one fluid dynamic property of the drilling mud being injected into the well and measuring at least one fluid dynamic property of the drilling mud returning to the surface during the transient flow state;

determining the compressibility of the fluid influx from a comparison of said fluid dynamic properties so as to indicate the nature of the fluid influx; and circulating the fluid influx from the well according to the indicated nature thereof.

2. The method according to claim 1 wherein the determined compressibility X of the fluids in the well is equal to the product $X_aV_a$ where $V_a$ is the volume of the annulus and $X_a$ is the compressibility of the fluids in the annulus.

3. The method according to claim 2, wherein the presence of gas in the well is determined by comparing the value of $X_a$ to a predetermined value, and wherein the pressure $P_g$ of the gas, its compressibility $X_g$, which is substantially equal to $1/P_g$, and the volume of gas $V_g$ present in the annulus are determined by the equation:

$$X_aV_a=X_gV_g.$$

4. The method according to claim 1 wherein said at least one fluid dynamic property of the drilling mud being injected into the well is the flow rate $Q_i$ and said at least one fluid dynamic property of the drilling mud returning to the surface is the pressure $P_r$.

5. The method according to claim 4 further comprising the step of measuring the flow rate $Q_r$ of return of the drilling mud to the surface.

6. The method according to claim 1 further including the steps of:

a) injecting an additional known volume of drilling mud into the well so as to pressurize the mud, which has the effect of creating the transient fluid dynamics state in the well;

b) measuring the successive values of the mud return pressure $P_r$ during said transient state;

c) determining the value of the compressibility $X_a$ of the fluid in the annulus; and d) comparing said value of compressibility $X_a$ to a predetermined value in order to ascertain the nature of the fluid that has penetrated into the annulus.

7. The method according to claim 4, further comprising the steps of:

measuring the flow rate $Q_r$ of the drilling mud returning at the surface after a time interval $d_t$ from the measurement of $Q_i$, determining the pressure difference $dP_r$ of the pressure during the time interval $d_t$, and determining the compressibility $X_a$ of the fluids in the annulus of the well from the equation:

$$\frac{Q_i - Q_r}{V_a} d_t = X_a dP_r$$

Wherein $V_a$ is the volume of fluids in the annulus of the well.

8. The method according to claim 1, further comprising:

isolating the well by closing a blow-out preventer and halting circulation of the drilling mud;

resuming circulation of the drilling mud through a choke so as to create said transient fluid dynamic state;

measuring the return pressure $P_r$ and the injection rate $Q_i$ during the transient state; and determining the compressibility of $X_a$ of the fluid in the annulus and comparing a predetermined value so as to ascertain the nature of the fluid influx.

9. The method according to claim 1 wherein the transient fluid dynamic state is created by changing the rate of flow of mud in the well.

10. The method according to claim 1 wherein the transient fluid dynamic state is created by changing the pressure of the mud in the well.

11. A method of analyzing a fluid influx in a well from an underground formation during a drilling operation, the method comprising the steps of:

a) closing a well blow-out preventer and halting circulation of drilling mud when a fluid influx is detected;

b) resuming circulation of the mud at the surface through a choke;

c) measuring successive values of the mud injection rate $Q_i$;

d) measuring successive values of the return pressure $P_r$ of the mud;

e) changing the flow rate $Q_i$ so as to create a transient flow-state of the drilling mud into the well;

f) comparing the changing values of $Q_i$ and $P_r$ during said transient state so as to determine the compressibility $X_a$ of the fluid in the well; and g) comparing the compressibility $X_a$ to a predetermined value in order to ascertain the nature of the fluid influx into the well.

12. The method according to claim 11, further comprising determining the value of a coefficient kd, which characterizes said choke.

* * * * *